US009834366B2

(12) United States Patent
Giuliani

(10) Patent No.: US 9,834,366 B2
(45) Date of Patent: Dec. 5, 2017

(54) THERMAL BAG FOR FOODS AND THE LIKE

(75) Inventor: Nicola Giuliani, Lucca (IT)

(73) Assignee: IM-BALL-CENTER S.r.L., Mozzano (IT)

( * ) Notice: Subject to any disclaimer, the term of this patent is extended or adjusted under 35 U.S.C. 154(b) by 3227 days.

(21) Appl. No.: 11/916,066

(22) PCT Filed: May 29, 2006

(86) PCT No.: PCT/IT2006/000403
§ 371 (c)(1),
(2), (4) Date: Aug. 11, 2008

(87) PCT Pub. No.: WO2006/129336
PCT Pub. Date: Dec. 7, 2006

(65) Prior Publication Data

US 2009/0034883 A1 Feb. 5, 2009

(30) Foreign Application Priority Data

Jun. 1, 2005 (EP) ..... 05425403

(51) Int. Cl.

| | |
|---|---|
| ***F25D 3/08*** | (2006.01) |
| ***B65D 81/38*** | (2006.01) |
| ***A45C 13/36*** | (2006.01) |
| *A45C 3/00* | (2006.01) |
| *A45C 3/04* | (2006.01) |

(52) U.S. Cl.

CPC ..... *B65D 81/3897* (2013.01); *A45C 13/36* (2013.01); *F25D 3/08* (2013.01); *A45C 3/001* (2013.01); *A45C 3/04* (2013.01); *B31B 2219/23* (2013.01); *B31B 2219/9077* (2013.01); *B31B 2219/9087* (2013.01); *B31B 2237/20* (2013.01); *F25D 2303/082* (2013.01); *F25D 2303/0845* (2013.01); *F25D 2331/801* (2013.01)

(58) Field of Classification Search

CPC ..... F25D 3/08; F25D 2331/801; F25D 2303/082; F25D 2303/0845

USPC ..... 62/457.1, 457.2, 457.7; 383/15, 109, 383/110, 116, 119, 120, 121, 122

See application file for complete search history.

(56) References Cited

U.S. PATENT DOCUMENTS

| | | | | |
|---|---|---|---|---|
| 3,537,360 | A | 11/1970 | Farnam | |
| 3,678,703 | A * | 7/1972 | Cornish et al. | 62/371 |
| 4,190,477 | A * | 2/1980 | Ossian et al. | 156/244.11 |
| 4,211,091 | A * | 7/1980 | Campbell | 62/372 |
| 4,759,642 | A * | 7/1988 | Van Erden et al. | 383/210.1 |

(Continued)

FOREIGN PATENT DOCUMENTS

| | | |
|---|---|---|
| DE | 1 218 867 | 6/1966 |
| DE | 296 12 070 | 10/1996 |

(Continued)

*Primary Examiner* — Dominick L Plakkoottam
*Assistant Examiner* — Daniel C Comings
(74) *Attorney, Agent, or Firm* — McGlew and Tuttle, P.C.

(57) ABSTRACT

The thermal bag (2) is made of thermally insulating composite material folded to form a bottom and welded along lateral borders (3) to form a body (1) of the bag with a mouth (5) at the level of which a handle (7A, 7B) is applied. The composite material defines a bottom folded in an accordion-like fashion opposite the mouth of the bag, and a laminar stiffening element (15) of the accordion-like bottom is disposed inside the bag.

23 Claims, 5 Drawing Sheets

(56) References Cited

U.S. PATENT DOCUMENTS

| | | | | |
|---|---|---|---|---|
| 4,925,438 | A | 5/1990 | Wagner | |
| 5,105,919 | A * | 4/1992 | Bomes et al. | 190/18 A |
| 5,158,371 | A * | 10/1992 | Moravek | 383/104 |
| 5,313,809 | A | 5/1994 | Isaacson et al. | |
| 5,478,988 | A | 12/1995 | Hughes et al. | |
| 5,850,911 | A | 12/1998 | Pakzad | |
| 5,912,058 | A * | 6/1999 | Takahashi et al. | 428/34.3 |
| 2001/0036520 | A1 | 11/2001 | Hall | |
| 2003/0035596 | A1 * | 2/2003 | Martineau et al. | 383/28 |
| 2004/0120611 | A1 | 6/2004 | Kannankeril et al. | |

FOREIGN PATENT DOCUMENTS

| | | | |
|---|---|---|---|
| FR | 2 497 497 | 7/1982 | |
| FR | 2 550 768 | 2/1985 | |
| FR | 2 587 302 | 3/1987 | |
| GB | 2225567 A * | 6/1990 | B65D 33/06 |

* cited by examiner

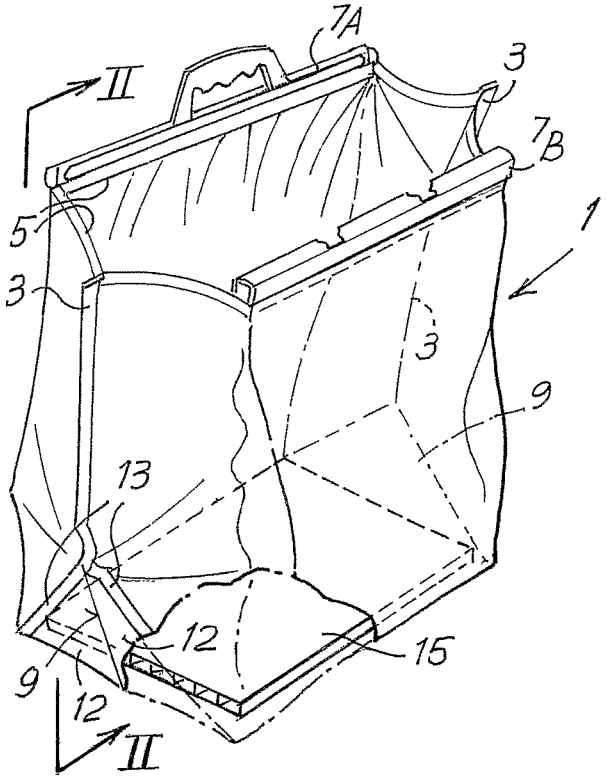
Fig.1
Fig.2
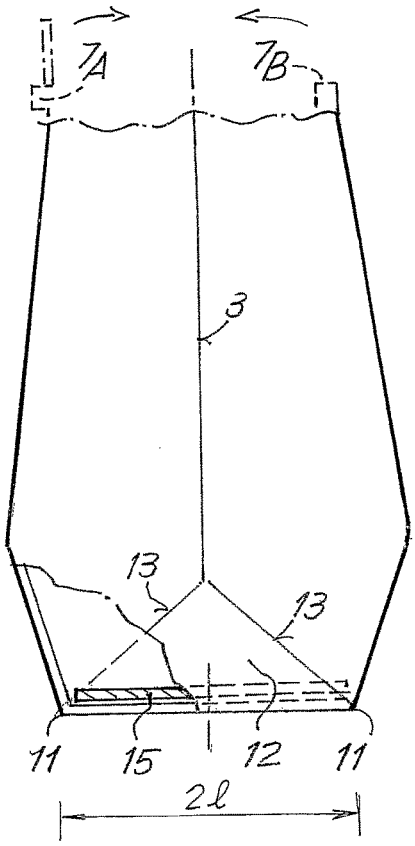
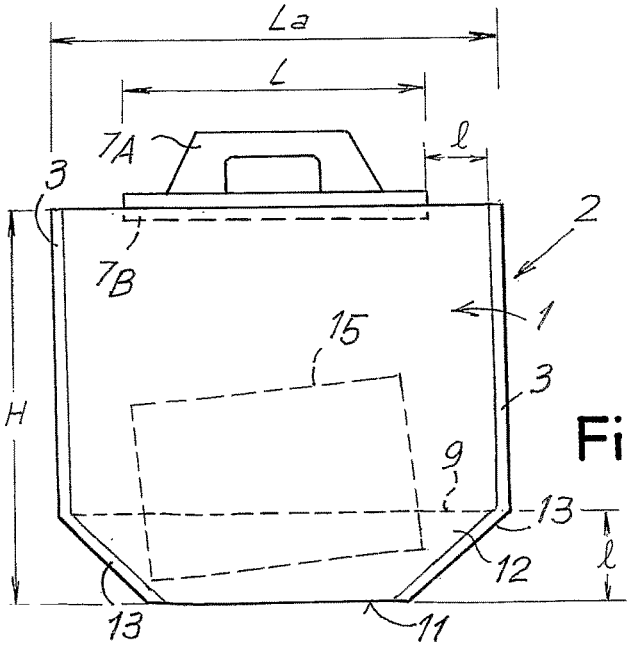
Fig.3

1A
1B
1C
2
3
7A
7B
9
11
12
13
15
S
V
VII

THERMAL BAG FOR FOODS AND THE LIKE

TECHNICAL FIELD

The present invention relates to improvements to thermal bags, typically used to transport frozen products.

BACKGROUND OF THE INVENTION

Bags of this type are formed of composite material and normally include an outer sheet, typically a sheet of metallized polymer film, an inner sheet of polymer film defining the inner surface of the bag and a thermally insulating intermediate sheet disposed between the outer sheet and the inner sheet. These sheets are folded to form the bottom of the bag and the outer and inner sheets are welded together along the borders. A handle with closing members is normally provided at the level of the mouth.

Bags of this type have relatively small capacities and can tear if loaded excessively.

Thermal bags of this type are described in FR-A-2550768, in FR-A-2587302 and in US-A-2003/0035596.

OBJECTS AND SUMMARY OF THE INVENTION

The object of the present invention is to produce a bag of the aforesaid type with increased capacity, which is more practical to use and is less likely to tear if it is overloaded.

In substance, according to the invention this and other objects, which shall be apparent to those skilled in the art from reading the text hereunder, are obtained with a bag as claimed in claim 1. The dependent claims relate to further advantageous developments and improvements of the invention.

In substance, the invention relates to a thermal bag made of thermally insulating composite material, folded to form a bottom and welded along lateral borders to form a body of the bag with a mouth at the level of which a handle is applied; wherein the composite material defines a bottom folded in an accordion-like fashion opposite the mouth of the bag, and wherein a laminar stiffening element of the accordion-like bottom is disposed inside the bag.

Preferably, the laminar stiffening element is separated from the composite material forming said bag. This simplifies the production process as the aforesaid element can simply be positioned loose in the bag and does not require particular operations to fasten it to the walls of the bag.

According to a possible particularly advantageous embodiment, the composite material is composed of a first outer sheet, a second inner sheet and a thermally insulating sheet interposed between said outer sheet and said inner sheet.

In a possible embodiment of the bag according to the invention, in the folded position the accordion forming the bottom of the bag has beveled borders along which welding lines are produced, the beveled borders on each side of the bag converging in a corner, the two opposed corners being joined by a folding line of the accordion-like bottom. Along the beveled borders welds can advantageously be formed between opposite portions of the inner surface of the second inner sheet of the composite material forming the bag.

To obtain a bag which is more functional and efficient in preserving the products inserted therein, in an improved advantageous embodiment of the invention the laminar stiffening element contains a refrigerating fluid, such as a mixture of water and monopropylene glycol.

In a possible embodiment the laminar stiffening element is made of cellular plastic, such as cellular polypropylene.

In a different embodiment, the stiffening element is made of cardboard enclosed in a cover made of a polymer material.

The outer sheet of the composite material forming the body of the bag can be composed of a multilayer metallized polymer material. This multilayer metallized polymer material can be composed of a polyester (PET) and low density polyethylene (LDPE) laminate.

In a possible embodiment the outer sheet made of multilayer polymer material has two outer layers in a material weldable to itself. For example, the outer sheet can be composed of a laminate comprising a layer of polyester (PET) interposed between two layers of low density polyethylene (LDPE) or of a coextruded multilayer of polypropylene, polyester and low density polyethylene. By way of example, said three layers can have a thickness of 25, 12 and 40 micrometers.

The composite material forming the body of the bag can also have a thermally insulating intermediate sheet composed of a foamed polymer material, such as a foamed low density polyethylene with closed cells.

The inner layer of composite material can be composed of low density polyethylene.

BRIEF DESCRIPTION OF THE DRAWINGS

The invention will be better understood by following the description and accompanying drawing, which shows a non-limiting practical embodiment of the invention. More specifically, in the drawing:

FIG. 1 shows a perspective view of a bag produced according to the invention in an open position;

FIG. 2 shows a side view II-II of FIG. 1;

FIG. 3 shows a front view of the bag in a folded position;

FIGS. 8A, 8B representing two subsequent portions of the line.

DETAILED DESCRIPTION OF AN EMBODIMENT OF THE INVENTION

Figure 1A:
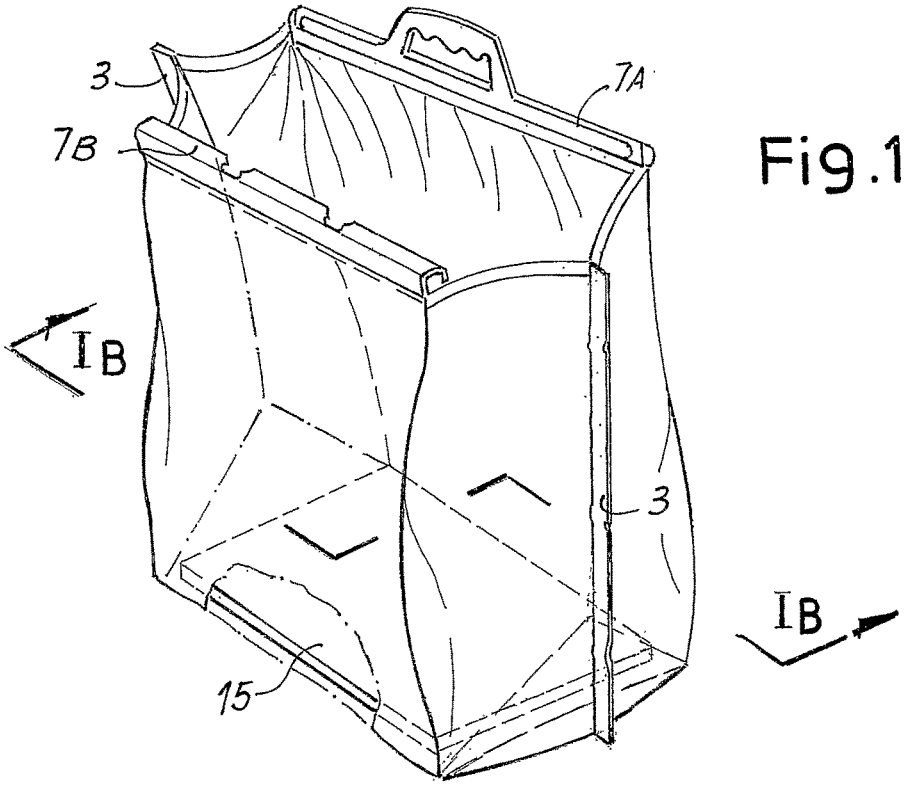
FIG. 1A shows a perspective view of a bag according to the invention in a modified embodiment.

The bag, indicated as a whole with 2, has a body 1 formed of a portion of composite laminar material. This material is folded to form a bottom of the bag with an accordion-like configuration and is welded along two lateral borders 3. The mouth of the bag is indicated with 5, welded along which is a handgrip or handle, formed by the portions 7A and 7B, which also form a closing device of the mouth of the bag.

The bottom of the bag 2 has an accordion-like configuration and is defined by a portion of the composite material folded along a central folding line 9 and two lateral folding lines 11. The folding lines 9 and 11 define two edges 12 of composite material which form the accordion defining the bottom of the bag. In the folded position (FIG. 3) it can be seen that the edges 12 are beveled and the bag has a lower portion defined, besides by the folding lines 11, by pairs of welding lines 13 inclined by approximately 45° with respect to the welded borders 3. In the extended position the accordion formed by the edges 12 and by the folding lines 11 and 9 takes the configuration shown in FIG. 5 and a laminar stiffening element 15, which is physically detached from the composite material forming the body 1 of the bag 2, rests on the inner surface of the extended accordion.

The composite sheet material which forms the body 1 of the bag 2 has (see enlargement in FIG. 7) a first outer sheet 1A, a second inner sheet 1B and an intermediate sheet 1C. In a possible embodiment the intermediate sheet 1C is composed of a foamed polymer material, typically and preferably a closed cell foamed material, such as a low density polyethylene (LDPE). The innermost sheet 1B can, for example, be composed of low density polyethylene, while the outer sheet 1A can be a coextruded multilayer material. In a possible embodiment the sheet 1A is composed of two layers, where the outer layer is polyester (PET) and the inner layer is low density polyethylene (LDPE). The outer layer is suitably metallized with aluminum.

With the configuration of the beveled accordion-like bottom shown in FIG. 3, the welding lines 13 are produced on opposite edges of the inner sheet 1B made of polyethylene or another weldable material. Being made of polyester, the faces opposite and in reciprocal contact of the outermost sheet 1A are not reciprocally welded. The bevel of the corners of the bottom of the bag make it possible to obtain, in the open position (FIG. 1) a bag without protruding corners, which otherwise would form in the absence of bevels along the welding lines 13.

To avoid beveling the base material forming the body 1 of the bag, an outer sheet 1A composed of a coextruded three-layer material, such as an intermediate layer of polyester and two outer layers of low density polyethylene, can be used. The second material can be welded to itself so that when the accordion forming the bottom of the bag is in the folded position, the bag can extend quadrangularly with borders 3 welded up to the folding lines 11 of the accordion-like bottom. In this case, opening the accordion the bag approximately maintains the shape of a parallelogram without protruding edges and with a welding border 3 which extends from the mouth 5 to the extended bottom. A bag produced in this way is shown in FIG. 1A.

Figure 1B:
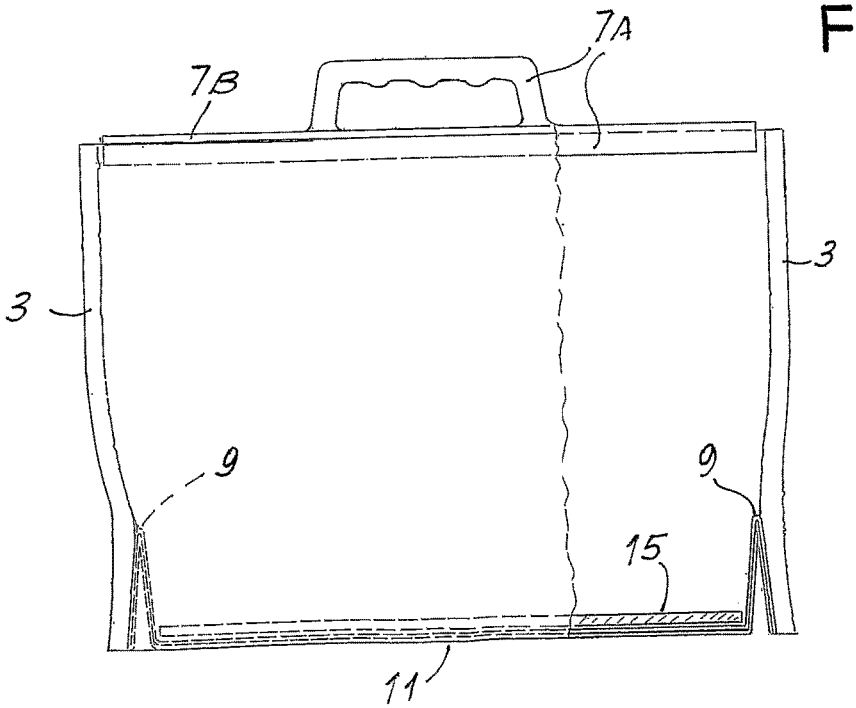
FIG. 1B shows a section according to IB-IB in FIG. 1A.
Figures 4, 5, 6, 7:
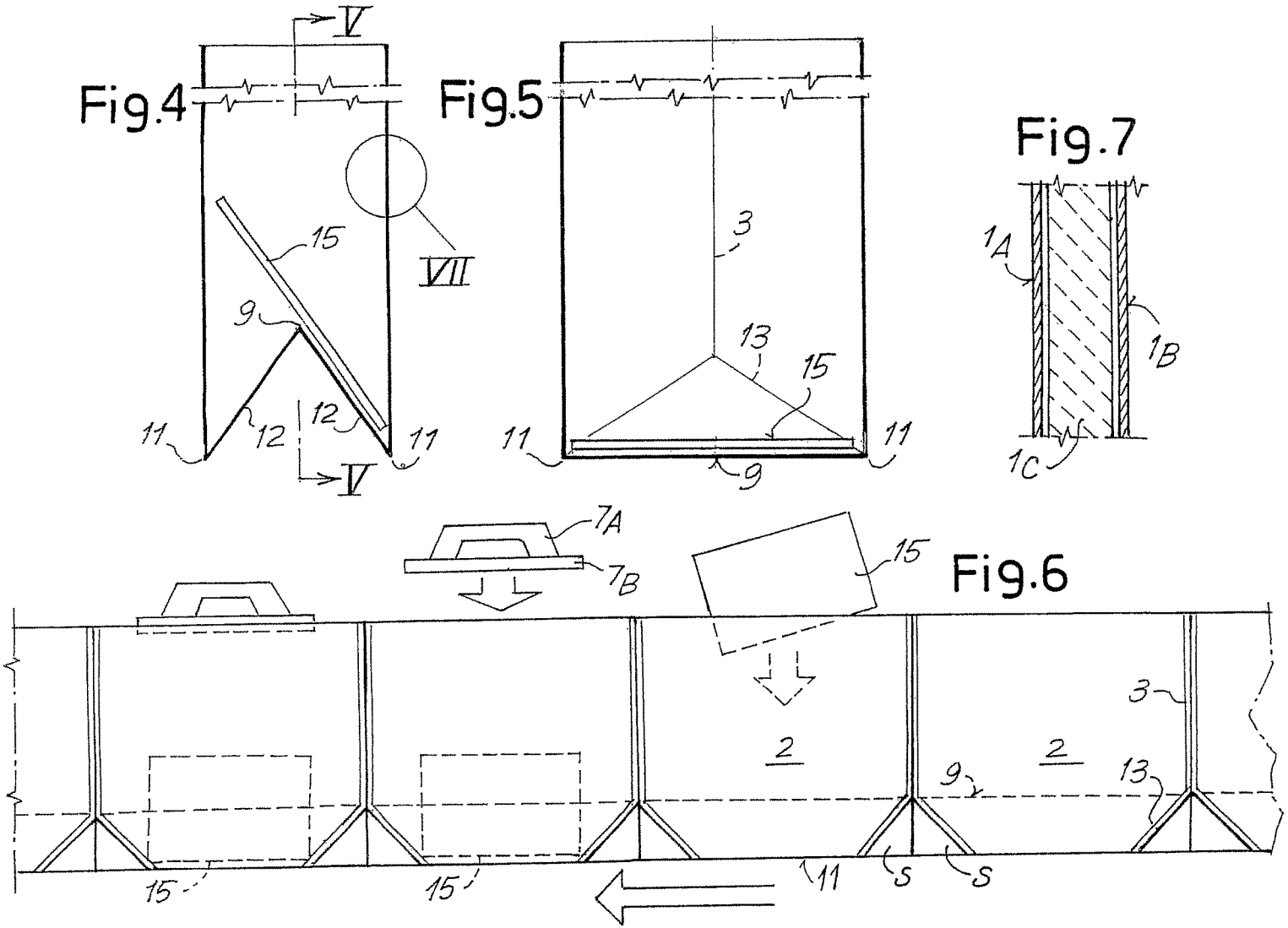
FIGS. 4 and 5 show cross sections according to a vertical plane of the bag in an intermediate opening phase and in an open position respectively.
FIG. 6 schematically shows the steps to produce the bag according to the invention.
FIG. 7 shows a schematic enlargement of the detail indicated with VII in FIG. 4.

Inserted inside the bag is a laminar stiffening element 15 rectangular in shape and with dimensions corresponding to the open accordion-like bottom (FIGS. 1 and 5).

The laminar stiffening element can, for example, be composed of a sheet of cellular polypropylene or also corrugated cardboard covered with a plastic film to avoid deterioration caused by condensate which can form on the products contained in the bag 2.

According to an advantageous embodiment, the rigid bottom can be made of plastic material, such as polypropylene, optionally cellular, inserted into a bag of polymer film, such as polyethylene or polyamide, containing a refrigerating mixture, i.e. a mixture capable of storing cold. Typically, this mixture can, for example, be a mixture of water and monopropylene glycol. As the laminar stiffening element is inserted loosely inside the bag, it can be removed from said bag and placed in a freezer to take the refrigerating mixture to low temperature. In this case, the stiffening element is used to stiffen the bottom of the bag and increase the stability and strength of the bag, consequently facilitating the use thereof, and also to preserve the degree of cold inside through storage of cold energy in the mixture contained in the cover surrounding the laminar stiffening element.

As can be seen in particular in FIG. 3, the handle or handgrip 7A, 7B has a dimension in length L less than the length La of the edges forming the mouth 5 of the bag, when said bag is flattened. Advantageously, the length L is less than the length La by an amount 2l, equal to or slightly less than the width of the accordion (see FIG. 2), when this is flattened, i.e. when the bag is in the position of maximum volume. This dimension 2l is therefore substantially more or less equal to or slightly less than the transverse dimension of the laminar stiffening element 15. More or less equal to or slightly less than is intended as a difference of the two lengths ranging approximately from 0 to 20%. In other words, the mouth of the bag can be smaller in dimensions to the flattened accordion, with a difference between the width of the mouth and the width of the accordion preferably no greater than 20%. This dimensioning of the handle allows the bag to take the completely open position shown in FIGS. 1 and 2, without the handle preventing the bag from being opened.

Moreover, to obtain a bag with sufficient capacity and stability in the open position, it is advantageous for the dimension 2l to be sufficiently large, typically approximately half the height H of the bag. In other words, the distance between the folding lines 11 and 9 (equal to l) is preferably approximately a quarter or more of the height of the bag.

The bag can be produced in a completely automated manner, as shown schematically in the sequence of operations in FIG. 6. The continuous composite material is folded in line, as shown in the section B-B, along three parallel longitudinal folding lines, indicated with 9 and 11, corresponding to the folding lines 9 and 11 on the finished article. Subsequently, the composite material is welded along the lines 3 and 13 and subsequently cut along the same lines to separate the bags 2 from one another and eliminate the triangular scraps S at the level of the inclined welding lines 13. The laminar stiffening element 15 is inserted through the mouth of the bag and the two components of the handle 7A and 7B, which have already been joined to each other, are applied along the two longer edges defining the mouth 5.

The entire process can take place without requiring manpower and consequently in totally hygienic conditions with a particular advantage in consideration of the fact that this type of container is intended to be used for foods.

Figure 8A:
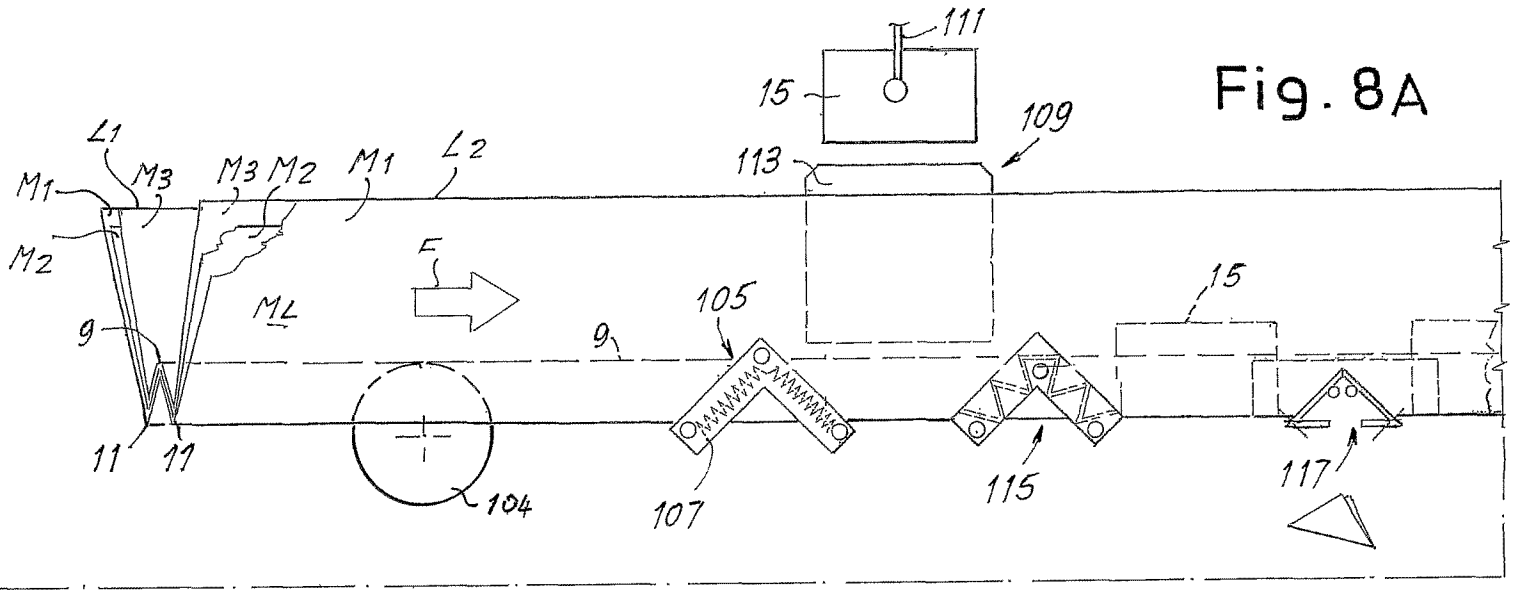
FIGS. 8A, 8B and 9 show a plan view of the production line and a side view of the initial area for insertion of the initial continuous material to produce the bags.
Figure 8B:
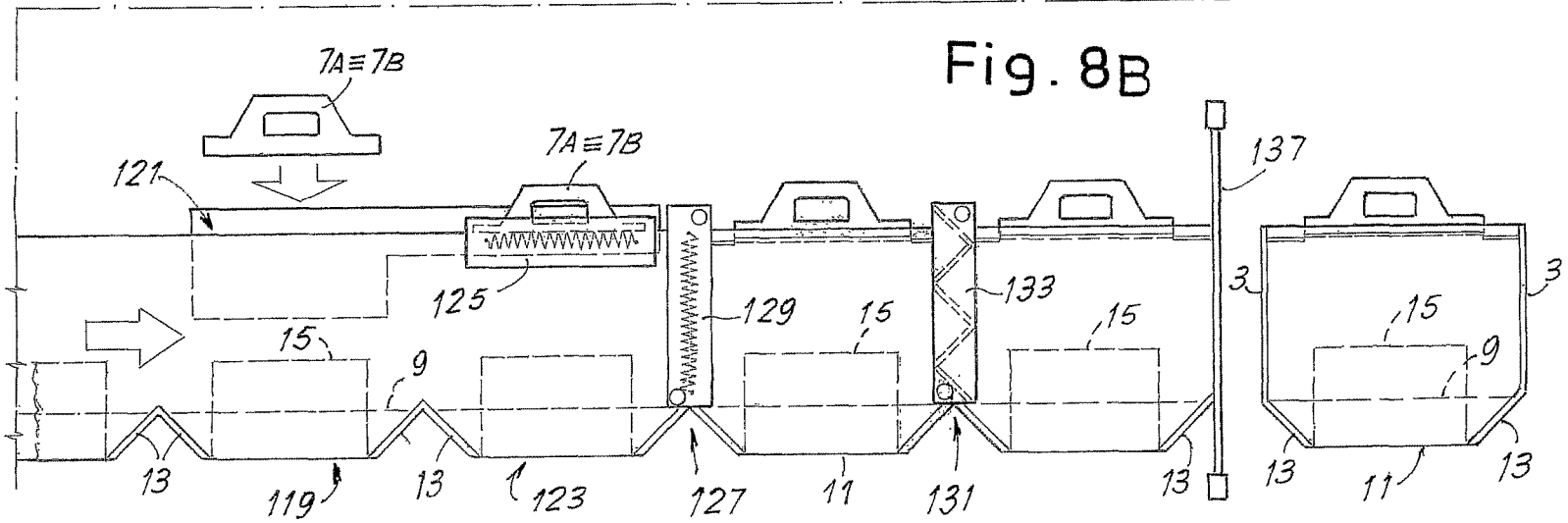
Figure 9:
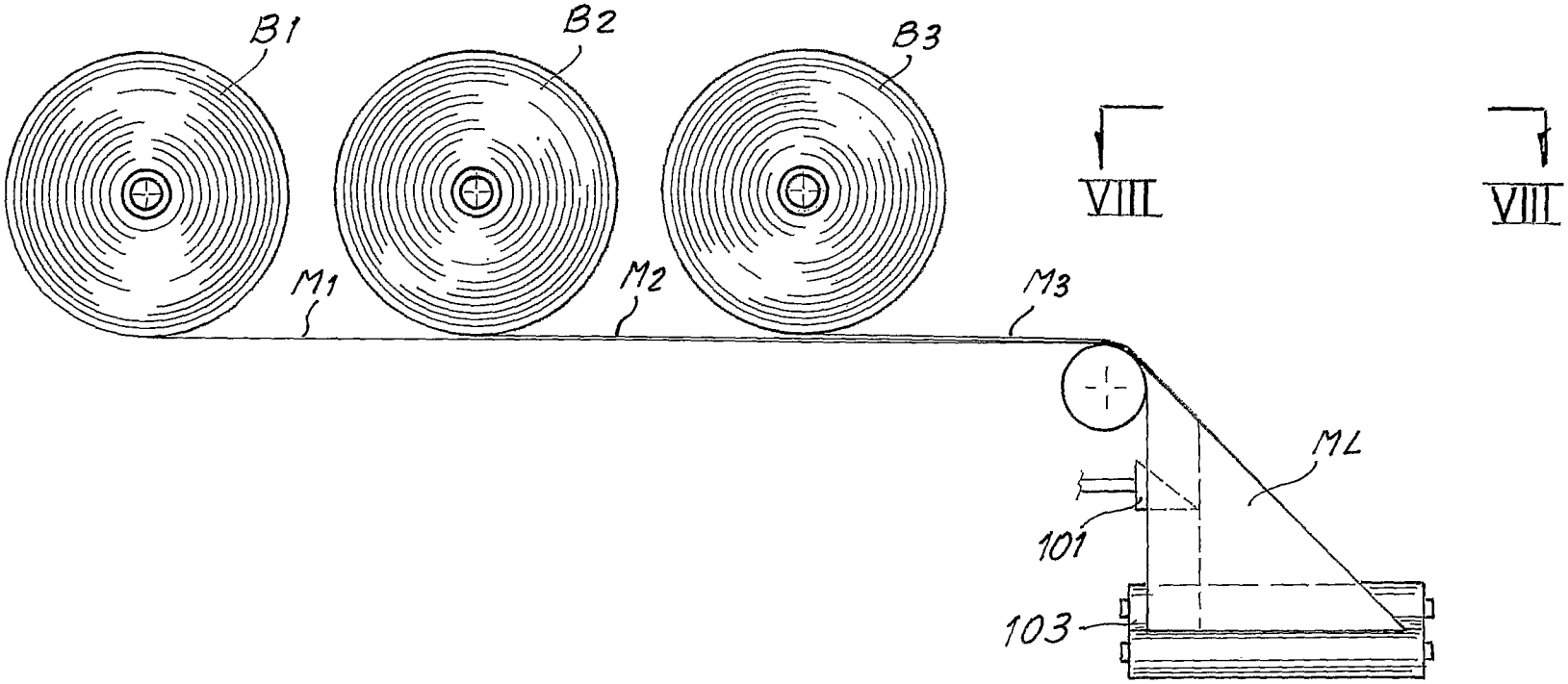

FIGS. 8A, 8B and 9 show a more detailed representation of the production line. The composite material to produce the bags is unwound from three separate reels B1, B2 and B3 respectively containing: the metallized web material M1 forming the outer layer of the composite material; the insulating web material M2 forming the intermediate layer of the composite material; the inner web material M3. The three superimposed layers M1, M2 and M3 are taken, by a position on the plane of the three materials M1, M2 and M3 with the longitudinal borders thereof L1, L2 adjacent and, by means of a folding triangle 101 are folded along the folding lines 9 and 11 corresponding to the lines 9 and 11 of the finished bag.

A pair of rollers 103 draws the composite material, indicated with Mc, according to the arrow F along a series of processing stations described hereunder. A fixed or rotating (motorized or idle) disc-shaped element 104, or other element with the same function, can be positioned directly downstream of the rollers 103. The function of this element is to stabilize folding 9 of the material M1, M2, M3 obtained by the folding triangle 101.

Downstream of the element 104 is a first station 105 comprising a welding device 107, which performs welding along inclined lines corresponding to the welding lines 13 of the finished bag. Downstream of the station 105 is a station 109 for inserting the laminar stiffening elements. A manipulator 111 picks up individual laminar elements from a pile (not shown) and inserts them between the edges L1, L2 held suitably spread apart by a spreading device schematically indicated with 113. Downstream of the station 109 is another station 115 in which the welding lines 13 performed by the welding bars of the welding device 107 are cooled, by cooling bars, e.g. chilled by cold water delivered from a cooling system, not shown.

Downstream of the station 115 is a station 117 in which two scissor blades or the like, cooperating with fixed blades, cut the trimming delimited by the welding lines 13 and the folding lines 11.

In the subsequent station 119 the handles 7A, 7B are applied to the edges L1, L2 which for this purpose are held spread apart by a spreading device 121 and in the subsequent station 123 welding is performed by a welding system 125 of the portions 7A, 7B of handle to the longitudinal borders L1, L2 and reciprocal welding of the materials M1, M2 and M3 along said borders.

In the subsequent station, indicated with 127, a transverse welding bar 129 is provided to perform welding along transverse lines that will define, on the finished bag, the welded edges 3. The weld has a width (i.e. a dimension in machine direction F) equal to double the width of the weld of the border 3 of each bag. Downstream of the cooling station 131, in which a chilled bar 133 cools this transverse weld, is a cutting station 135 in which a scissor blade cooperating with a counter-blade, or a hot wire system or the like, performs the transverse cut and separates the individual bags 1 along the welding lines made by the welding bar 129.

When the bag is produced as in FIG. 1A, with the external material M1 which can be welded to itself, or when the triangular trimmings at the sides of the bottom do not require to be eliminated, the station 117 can be omitted or left idle.

Moreover, according to a different embodiment, the welds along the borders 3 and 13 can be produced in a single station as can cooling of the welds. In this case welding takes place downstream of the station 109 and preferably downstream of the station 123. However, in this case it is more complex to modify the dimension of the accordion-like bottom portion of the bag, and in particular the distance between the folding lines 11 and the folding line 9. This is because the position and dimension of the welding lines 13 must be modified. This requires modification of the welding blade and of the cooling bar, which will have a Y-shape. With the configuration in FIGS. 8A, 8B, on the other hand, the dimension of these welding lines, performed in the station 105 and cooled in the station 115, can be modified simply by moving the bars or welding blades transversely with respect to the machine direction F. This is also the case for the cooling bars of the cooling station 115 and for the cutting blades in the station 117.

If the weld along the inclined lines 13 and the transverse lines 3 is performed in an single station with a single shaped welding bar or blade, a single shaped cutting blade can be provided to perform, in just one movement, the cut along the welding lines. Vice versa, a double cutting station, or a double cutting arrangement can be maintained: transverse along the borders 3 and inclined along the lines 13.

Although less advantageous, it would also be possible first to perform the transverse welding line at the level of the border 3 of the bag and, downstream thereof, the inclined welding lines at the level of the welding borders 13.

It is understood that the drawing purely shows an example provided by way of a practical embodiment of the invention, which may vary in forms and arrangements without however departing from the scope of the concept on which the invention is based.

The invention claimed is:

1. A thermal bag, comprising:

thermally insulating composite material folded to form a bottom and welded along lateral borders to form a body of the bag with a mouth at the level of which a handle is applied, said handle having a hand grip portion and a longitudinal portion forming at least a portion of a closing device for said mouth, said composite material defining a bottom folded in an accordion-like fashion opposite the mouth of the bag, wherein a laminar stiffening element of the accordion-like bottom is disposed inside the bag, said hand grip portion and said longitudinal portion having a shorter length than a length of said mouth when the bag is in a flattened position, wherein in the folded position an accordion forming the bottom of the bag has beveled borders along which welding lines are produced, the beveled borders on each side of the bag converging in a corner, the two opposed corners being joined by a folding line of the accordion-like bottom.

2. A thermal bag as claimed in claim 1, wherein the difference between the length of the handle and the length of said mouth is equal to at least approximately the width of the accordion-like bottom, when said bag is in an extended position.

3. A thermal bag as claimed in claim 1, wherein the length of said handle is substantially equal to or slightly less than the transverse dimension of the laminar stiffening element.

4. A thermal bag as claimed in claim 1, wherein said laminar stiffening element is separated from the composite material forming said bag and positioned loose in said bag.

5. A thermal bag as claimed in claim 1, wherein said composite material is composed of a first outer sheet, a second inner sheet and a thermally insulating sheet interposed between said outer sheet and said inner sheet.

6. A thermal bag as claimed in claim 1, wherein said composite material is composed of a first outer sheet, a second inner sheet and a thermally insulating sheet interposed between said outer sheet and said inner sheet, and wherein along said beveled borders welds are formed between opposite portions of the inner surface of the second inner sheet of the composite material forming the bag.

7. A thermal bag as claimed in claim 1, wherein said laminar stiffening element contains a refrigerating fluid.

8. A thermal bag as claimed in claim 7, wherein said fluid is composed of a mixture of water and monopropylene glycol.

9. A thermal bag as claimed in claim 1, wherein said laminar stiffening element is made of cellular plastic.

10. A thermal bag as claimed in claim 9, wherein said laminar stiffening element is made of cellular polypropylene.

11. A thermal bag as claimed in claim 1, wherein said laminar stiffening element is made of cardboard enclosed in a cover made of a polymer material.

12. A thermal bag as claimed in claim 1, wherein said composite material has an outer sheet composed of a multilayer metallized polymer material.

13. A thermal bag as claimed in claim 12, wherein said outer layer is composed of a polyester (PET) and low density polyethylene (LDPE) laminate.

14. A thermal bag as claimed in claim 12, wherein said outer sheet made of multilayer polymer material has two outer layers in a material weldable to itself.

15. A thermal bag as claimed in claim 12, wherein said outer sheet is composed of a laminate comprising a layer of polyester (PET) interposed between two layers of low density polyethylene (LDPE).

16. A thermal bag as claimed in claim 12, wherein said outer layer is composed of a laminate comprising a layer of propylene, a layer of polyester and a layer of low density polyethylene.

17. A thermal bag as claimed in claim 1, wherein said composite material has a thermally insulating intermediate sheet composed of a foamed polymer material.

18. A thermal bag as claimed in claim 17, wherein said foamed polymer material is a foamed low density polyethylene with closed cells.

19. A thermal bag as claimed in claim 1, wherein said composite material includes an inner layer made of low density polyethylene.

20. A thermal bag as claimed in claim 1, wherein the accordion-like bottom in the open position has a width approximately equal to half the height of the bag.

21. A thermal bag, comprising:

a bag body comprising a bag mouth portion, a handle, a bag bottom portion and lateral borders, said bag bottom portion, said mouth portion and said lateral borders comprising thermally insulating composite material, said bag bottom portion having a bag bottom portion length, said bag mouth portion having a bag mouth portion length, said bag body being welded along said lateral borders, said handle comprising an integral portion extending in a longitudinal direction of said handle, said integral portion defining at least a portion of a closing device for said mouth, said integral portion engaging said bag mouth portion, said integral portion having an integral portion length, said integral portion length being less than said bag mouth portion length with the bag body in a flattened position, said bag bottom portion length being less than said bag mouth portion length, said bag bottom portion length being less than said integral portion length; and a laminar stiffening element disposed inside the bag.

22. A thermal bag in accordance with claim 21, wherein said bag bottom portion is folded in an accordion-like fashion opposite the bag mouth portion.

23. A thermal bag in accordance with claim 22, wherein in the folded position the bag bottom portion has beveled borders along which welding lines are produced, the beveled borders on each side of the bag converging in a corner, the two opposed corners being joined by a folding line of the bag bottom portion.

* * * * *